United States Patent [19]

Eiermann et al.

[11] Patent Number: 5,039,289

[45] Date of Patent: Aug. 13, 1991

[54] ROTARY PISTON BLOWER HAVING PISTON LOBE PORTIONS SHAPED TO AVOID COMPRESSION POCKETS

[75] Inventors: Dankwart Eiermann, Weissensberg; Wolfgang Sohler, Wangen, both of Fed. Rep. of Germany

[73] Assignee: Wankel GmbH, Berlin, Fed. Rep. of Germany

[21] Appl. No.: 471,033

[22] Filed: Jan. 26, 1990

Related U.S. Application Data

[63] Continuation of Ser. No. 784,722, Oct. 4, 1985, abandoned, which is a continuation-in-part of Ser. No. 667,952, Nov. 2, 1984, Pat. No. 4,867,659.

[30] Foreign Application Priority Data

Nov. 7, 1983 [DE] Fed. Rep. of Germany ..... 3340202

[51] Int. Cl.[5] ..... F04C 18/18

[52] U.S. Cl. ..... 418/190; 418/206

[58] Field of Search ..... 418/206, 190

[56] References Cited

U.S. PATENT DOCUMENTS

| | | | |
|---|---|---|---|
| 264,962 | 9/1882 | Roots | 418/206 |
| 533,292 | 1/1895 | Green | 418/206 |
| 559,703 | 5/1896 | Green | 418/206 |
| 647,951 | 4/1900 | Enyart | 418/206 |
| 3,817,667 | 6/1974 | Winkelstrater et al. | 418/206 |

FOREIGN PATENT DOCUMENTS

| | | | |
|---|---|---|---|
| 1653900 | 9/1970 | Fed. Rep. of Germany | 418/190 |
| 224639 | 7/1985 | German Democratic Rep. | 418/206 |
| 389287 | 5/1971 | U.S.S.R. | 418/206 |
| 613137 | 6/1978 | U.S.S.R. | 418/206 |
| 616485 | 1/1949 | United Kingdom | 418/206 |
| 871588 | 6/1961 | United Kingdom | 418/206 |

*Primary Examiner*—John J. Vrablik

*Attorney, Agent, or Firm*—Robert W. Becker & Associates

[57] ABSTRACT

An external-axial rotary piston blower with two-arm or two-lobe pistons having cylindrical inner and outer advance surfaces and transitional surfaces between the advance surfaces, which extend from inner advance surfaces defining a partial circle or arc of 90° into smooth, level or even inner transitional surfaces at right angles to the tangent to this partial circle or arc as far as to a curve or rounding-off, over which the pistons roll-off or move and from this rounding-off or curve into smooth, level or even outer transitional surfaces, which are inclined to the longitudinal axis of the piston at an angle of 120°, whereby the outer edges of the inner transitional surfaces of both of the two pistons then contact or engage, when these transitional surfaces are located or lie in a plane with the positioning of the pistons of 45° to the longitudinal housing axis.

9 Claims, 5 Drawing Sheets

Fig, 4

ROTARY PISTON BLOWER HAVING PISTON LOBE PORTIONS SHAPED TO AVOID COMPRESSION POCKETS

BACKGROUND OF THE INVENTION

This is a continuation of a continuation-in-part application of U.S. Ser. No. 784,722-Eiermann et al filed Oct. 4, 1985, abandoned, based upon co-pending parent application of U.S. Ser. No. 667,952-Eiermann et al filed Nov. 2, 1984, now U.S. Pat. No. 4,867,659-Eiermann et al dated Sept. 19, 1989 belonging to the assignee of the present invention.

FIELD OF THE INVENTION

The present invention relates to a rotary piston blower having a housing formed by two inner cylindrical surfaces intersecting each other and two sidewalls. The sidewalls have shafts journalled thereby concentric to the two inner cylindrical surfaces and rotating oppositely with equal speed or velocity. Each shaft has a dual-vane piston arranged thereon with each piston being symmetrical in itself and identical with respect to the other piston. Each piston on the vanes thereof has external cylindrical surfaces that run upon the inner cylindrical surface and also having inner cylindrical surfaces running up upon the outer cylindrical surfaces of the counter piston as well as having transition surfaces forming the flanks or sides of the vanes and located between the inner and outer cylindrical surfaces, which mesh into engagement with the transition surfaces of the counter piston.

Such blowers form long surface seals relative to the inner cylindrical surface in a manner different from Roots-type blowers although systematically in itself being of a type to be compared therewith; and also such blowers avoid wedge gaps narrowing themselves in rolling-off the pistons relative to each other during engagement of the pistons among each other. Such wedge gaps in narrowing themselves lead to compression flows and considerable drive resistances.

DESCRIPTION OF THE PRIOR ART

Austrian Patent 26 70 92 and German Offenlegungsschrift 25 34 422 describe such rotary piston machines with a proposed multi-stage relationship thereof having disadvantages. The transition surfaces in radial section of shape or contour are described from the edge of the outer advance surface of the one piston against the other piston in an epicycloid according to these two prior art disclosures, whereby a complete sealing is to be attained. With that however, before and after the edges produced by the cylindrical surfaces and transitional surfaces relative to each other encounter gas enclosures formed therebetween and being compressed in themselves. The energy necessary for the gas enclosure compression considerably increases the power requirement for driving such a machine. Such power requirement cannot be regained by return expansion, since these gas enclosures open again during further rotation.

Considerable energy-consuming gas compression flows result thereby however that additionally during closing and opening of these gas enclosure spaces or chambers.

SUMMARY OF THE INVENTION

An object of the present invention is the avoidance of such gas enclosures compressing themselves and avoidance of gas compression flows during engagement or meshing of the transitional surfaces among each other with the machines of the type under consideration.

The blower according to the present invention in contrast to the previously known blowers with dual-vane pistons has a considerably smaller or more nominal power requirement, since gas compressions of enclosed working gases during meshing of the pistons as well as gas compression flows are avoided. For the same reason, there is also attained a reduction of the otherwise very unfavorable and disadvantageous noise generation experienced with such blowers.

This object, and other objects and advantages of the present invention, will appear more clearly from the following specification in connection with the accompanying drawings, in which.

Figure 4:
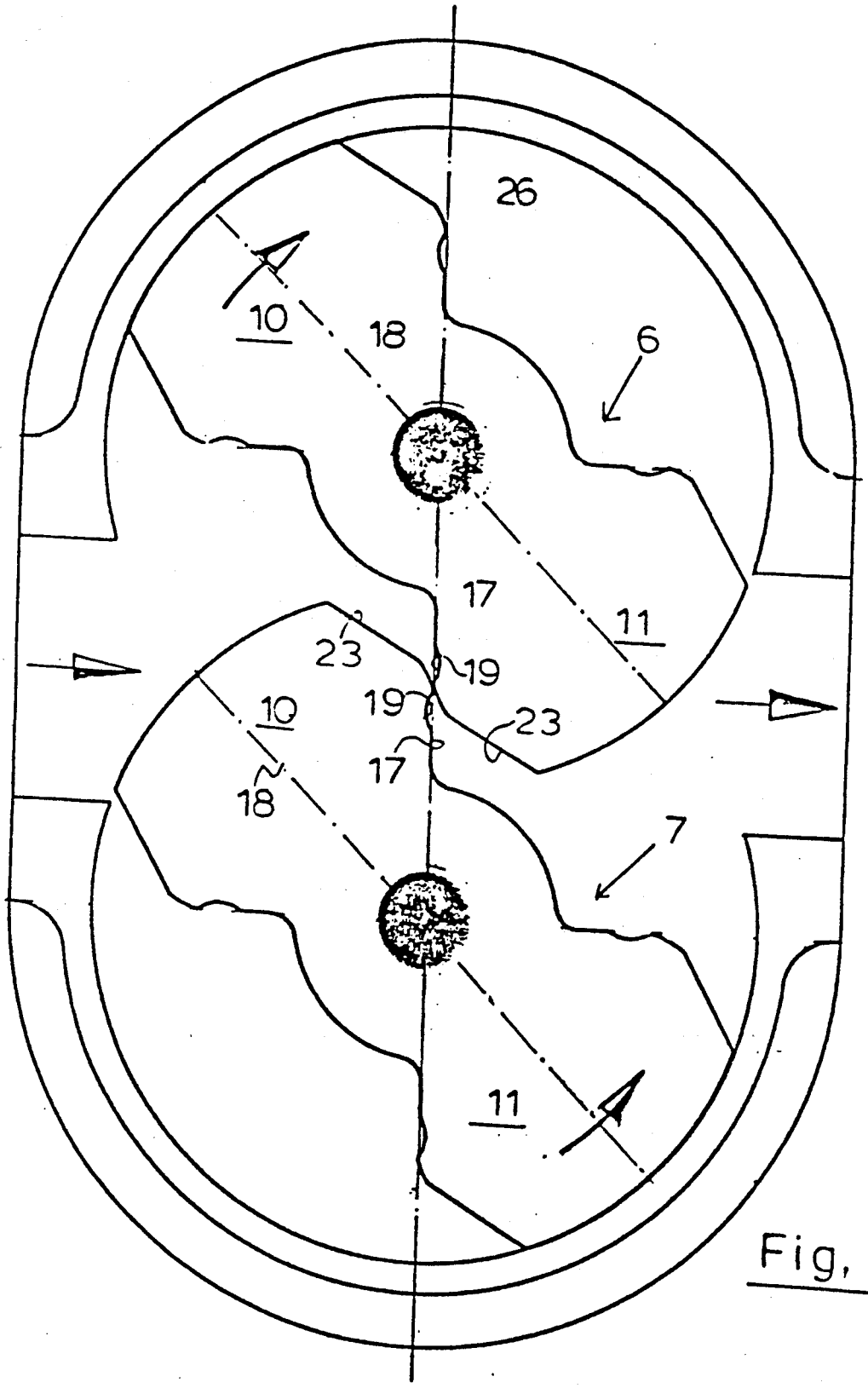
Figure 5:
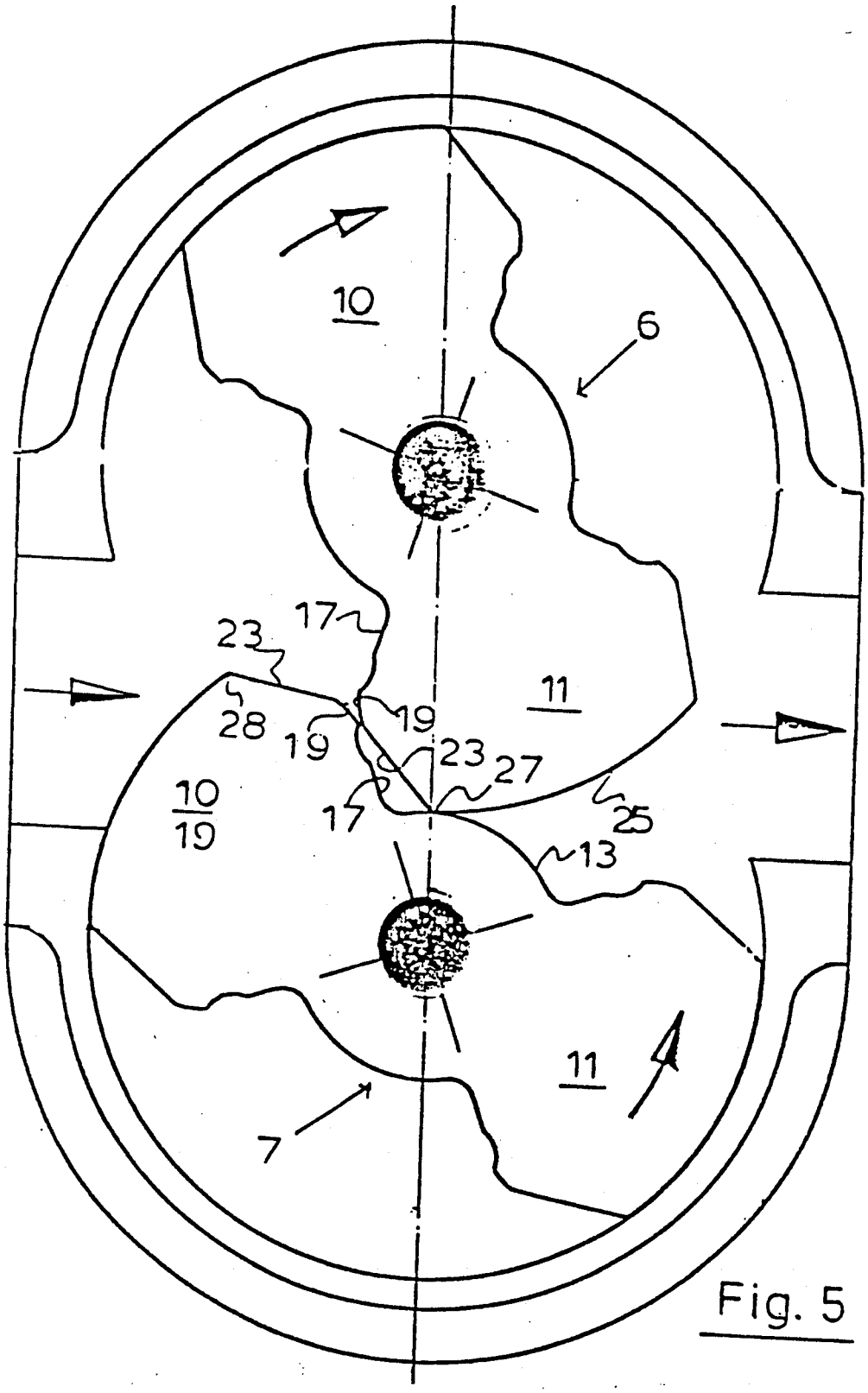

FIG. 4 is a view that shows schematic illustration of the blower having the dual-vane pistons located in meshing and contacting relationship relative to each other although positioned substantially parallel to each other in a fourth relationship or positioning of the pistons with respect to each other; and FIG. 5 is a view that shows schematic illustration of the blower having the dual-vane pistons meshing in cooperating relationship relative to each other and positioned angularly at different locations in a fifth positioning illustration thereof.

DETAILED DESCRIPTION OF PREFERRED EMBODIMENTS

Figure 1:
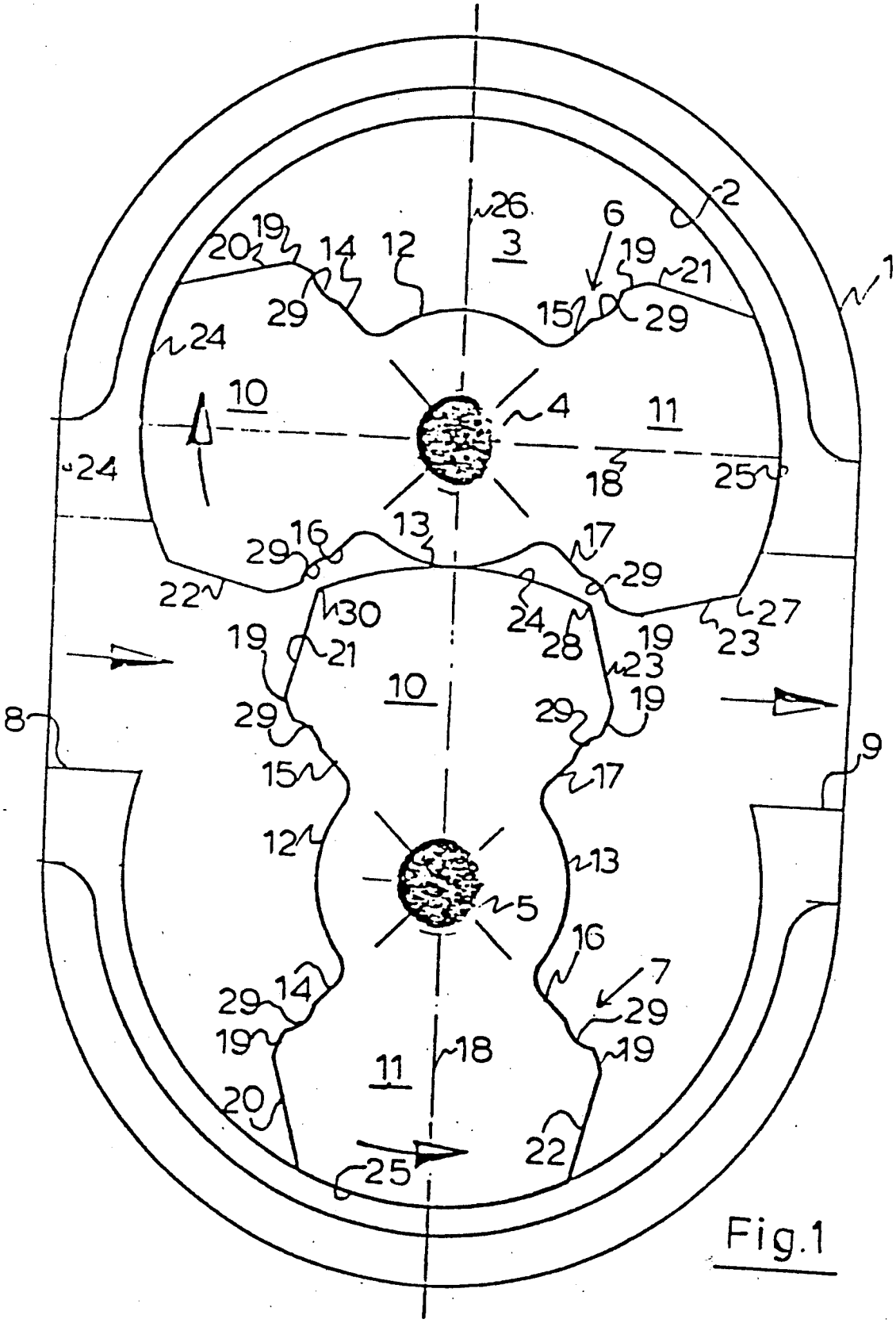
FIG. 1 is a view that shows a schematic illustration of a rotary piston blower having a housing formed by two inner cylindrical surfaces and sidewalls as well as having dual-vane pistons of which one piston is located horizontally and the other piston is located vertically in a first of five positions of these pistons relative to each other.

Referring now to the drawings in detail, FIG. 1 schematically shows a radial section through a blower having features in accordance with the present invention. The blower includes a housing 1 having an inner cylindrical surface 2 and a sidewall 3 illustrated in a plan view thereof. Furthermore, shafts 4 and 5 are shown extending through the housing 1 and located at right angles to the sidewalls. Pistons 6 and 7 are provided on the shafts 4 and 5 respectively and these pistons are identical with respect to each other and also symmetrical in themselves as well as being adapted to counter-rotate opposite to each other. An inlet opening 8 and an outlet or discharge opening 9 for the operating or working gas or medium can be provided in the region of the intersections of the inner cylindrical surfaces.

Inner cylindrical surfaces 12 and 13 as well as outer cylindrical surfaces 24 and 25 with large and small radius are provided by every piston 6 and 7 between the arms, lobes or vanes 10 and 11 thereof respectively. The sides of the lobes or vanes 10 and 11 of the pistons 6 and 7 running along the housing surfaces are cylindrical surfaces 24 and 25 with large radius concentric with the axes of these pistons. Cylindrical surfaces 12 and 13 with small radius are provided with these outer cylindrical surfaces 25 and 26 between the lobes or vanes 10 and 11. These inner cylindrical surfaces 12 and 13 extend over an arcuate distance of 90°. The cylindrical surfaces 12 and 13 have a transition tangentially of this arcuate distance and proceed into the inner transition surfaces 14, 15, 16, 17. These transition surfaces 14, 15, 16, 17, extend over an arcuate distance of 120° relative to the longitudinal axis 18 of the piston in a transitional portion 19 of FIGS. 1-3. In other words, the cylindrical surfaces 12 and 13 with the small radius on the one hand and the cylindrical surfaces 24 and 25 with large radius on the other hand are connected by transitional surfaces 29, which are formed of an inner even or smooth engagement surface 14 to 17 and of an even or smooth outer engagement surface 20 to 23. These transitional surfaces 29 bend away or diverge from the cylindrical surfaces 12, 13 with a small radius in an angle of 90° to the tangent thereof with respect to the inner engagement surface 14 to 17. The inner engagement surfaces 14 to 17 and the outer engagement surfaces 20 to 23 are angled-off outwardly at an angle of 120° among each other. The transition surfaces extend from this transitional portion 19 into the outer transition surfaces 20, 21, 22, 23, as far as to the cutting edge thereof with the outer cylindrical surfaces 24, 25, which accordingly define a partial circle or arc of 50° in a radial direction. The transitional portion 19 results from an epicycloid, which is defined during rolling-off relative to the counter piston. However, for simplification of fabrication or manufacturing thereof, especially with respect to the sealing gap or close "meshing" and interacting relationship between the pistons, the same can be replaced by a circular arc or curve 19 of FIG. 4. The radial distance or extent of the inner transitional surfaces 14, 15, 16, 17, and the beginning of the curve 19 (FIGS. 1 to 4) results from the positioning of the pistons as illustrated in FIG. 4, in which the longitudinal axes 18 of the pistons 6 and 7 are located in an angle of 45° relative to the vertically shown (FIG. 4) longitudinal axis of the housing 1. In this position, the inner transitional surfaces 17 of the two pistons 6 and 7 are located in a plane and the outer edges thereof that lie in a position in engagement against each other, aside from the sealing gap or close "meshing" and interacting relationship between the pistons. On the other hand, there results the outer boundary edge of the curves 19 (FIGS. 1 to 4), accordingly the position of the inner edges of the outer transitional surfaces 20, 21, 22, 23, as apparent from the position from the pistons show in FIG. 5. In this position, the corner 27 of the upper piston 6 formed by the outer transitional surface 23 and the outer cylindrical surface 25 of the upper piston 6 come into engagement with the inner cylindrical surface 13 of the lower piston 7. The outer boundary edge of the curve 19 is then located and lies opposite to or across from the outer boundary edge of the transitional surface 17 of the lower piston 7.

Figure 2:
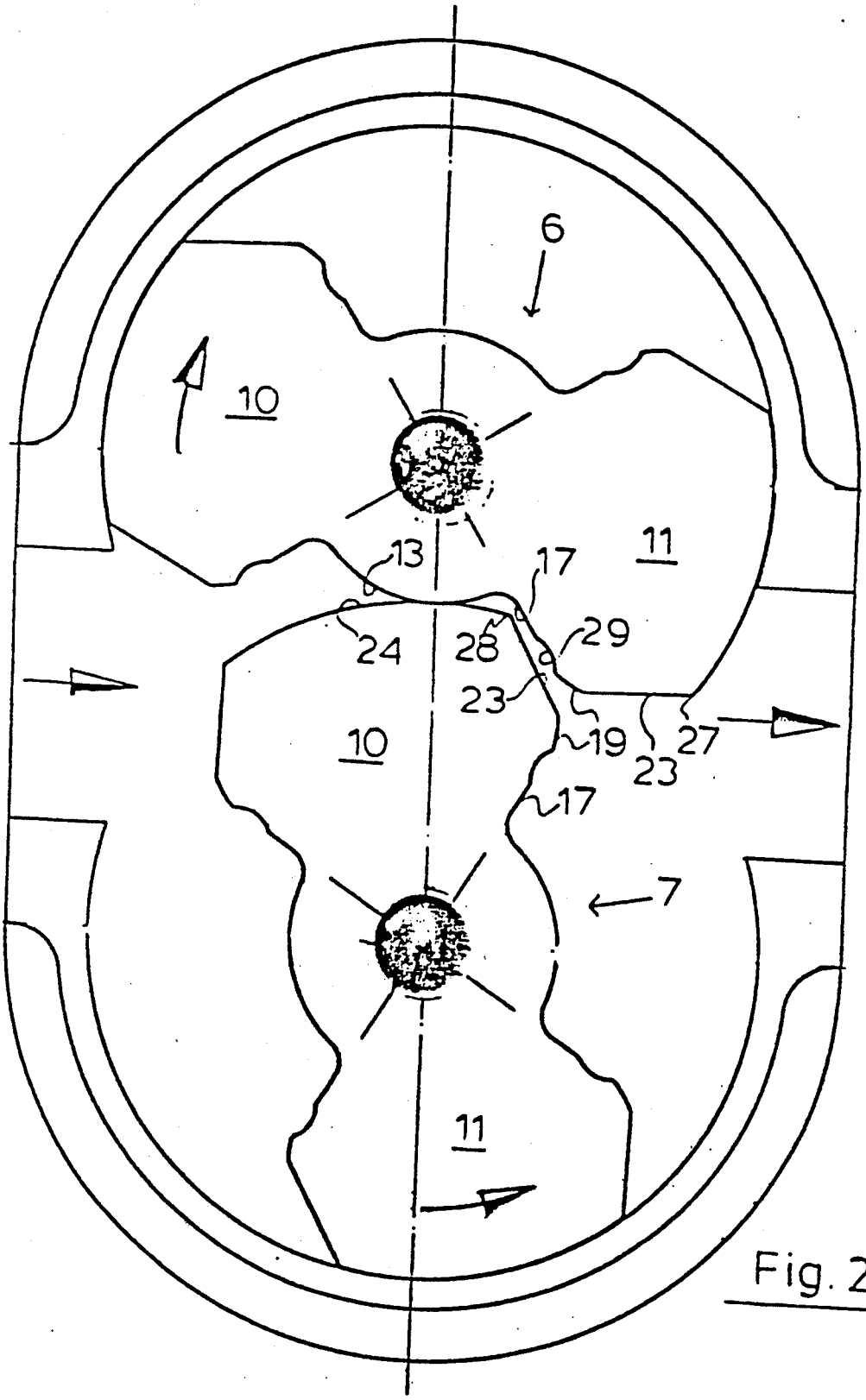
FIG. 2 is a view that shows a schematic cross-sectional illustration of the blower of FIG. 1 in which the dual-vane pistons are moved into meshing positions inclined slightly out of the positions shown in the original positioning of FIG. 1.
Figure 3:
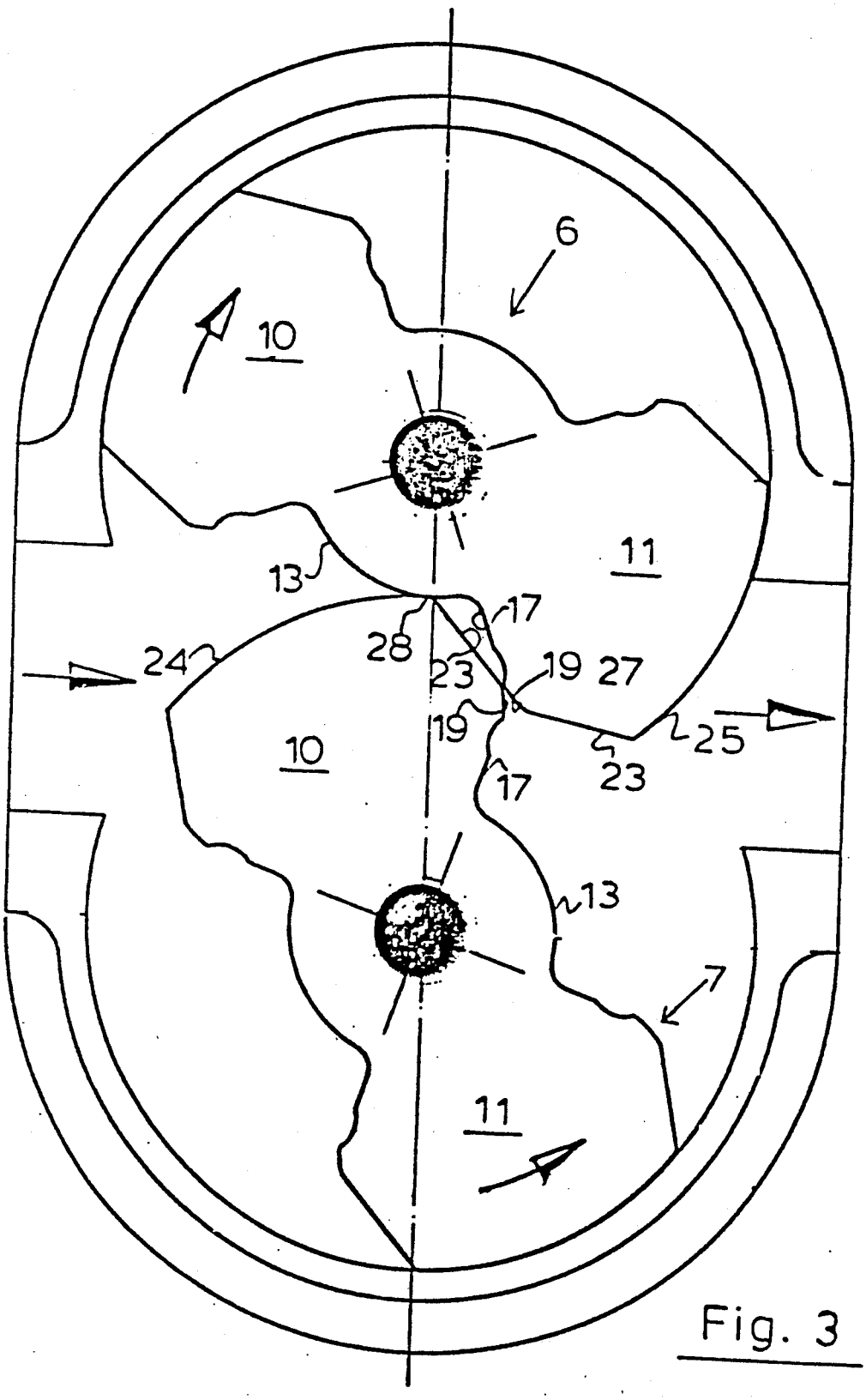
FIG. 3 is a view that schematically illustrates the meshing pistons of the blower of FIGS. 1 and 2 subject to further rotation of the dual-vane pistons relative to each other.

The curves 19 of the two pistons 6 and 7 accordingly "mesh" and interfit among each other beginning with a turning or rolling-off movement progressively continuing via sliding or gliding interaction therebetween from the piston position shown in FIG. 3, in which the corner 28 of the lower piston formed by the outer cylindrical surface 24 and the outer transition surface 23 comes out of engagement with the inner cylindrical surface 13 of the upper piston 12. This rolling-off procedure is terminated in a position illustrated in FIG. 5, when the outer cylindrical surface 25 of the upper piston 6 comes into contact or engages with the inner cylindrical surface 13 of the lower piston 7. This means, that the seal or close "meshing" and interacting relationship between the two pistons 6 and 7 is taken over by the transition portion 19 beginning from the position in FIG. 2 from the cylindrical surfaces 12 and 24, until the following cylindrical surfaces 13 and 25 again come into contact or engagement accordingly.

The construction of the piston flanks or sides described herewith is radially symmetrically equal or alike on all four sides of the arms, lobes or vanes of each piston 6, 7. The flanks or side contours are set back or offset by a small or nominal amount relative to the inner cylindrical surface 2 and relative to the counter piston, in order to make possible a running or an operation free of engagement or contact with the narrowest or closest sealing gaps involved therewith.

At the radially outer end of the inner transitional surfaces 14, 15, 16, 17, there are recesses 29 extending over the entire axial length thereof. These recesses 29 facilitate the dispersal or flowing-off of the working or operating medium, when one of the inner transitional surfaces 14, 15, 16, 17, is located opposite to or across from one of the outer transitional surfaces 20, 21, 22, 23.

Eight passes of the transitional surfaces 14, 15, 16, 17 and 20, 21, 22, 23, result during every rotation of the shafts 4 and 5 with the blower as described. Moreover, the transitional surfaces run-off or operate against one another in the following sequence when beginning with the positioning in FIG. 1: 17 against 23; 23 against 17; 21 against 16 and 15 against 22 as well as in a repetition 14 against 20; 20 against 14; 22 against 15 and 16 against 21; whereby respectively the second reference numeral designates the lower piston. Accordingly, first the arm, lobe or vane 11 of the upper piston 6 passes through hereby at the side of the lower piston 7 to the right thereof in the position of FIG. 1; and then the arm, lobe or vane 10 to the upper piston 6 passes through at the other side of the piston 6.

The inner transitional surface 17 of the upper piston 6 in the positioning of FIG. 2 approaches and closes in relation to the outer transitional surface 23 of the lower piston 7 as far as to a parallel positioning of both of the two surfaces 17, 23. The escape of the working or operating gas located then between the surfaces and passing around the transitional portion 19 to the pressure side is improved by the recess, indentation or niche 29 in the transitional surface 17 of the upper piston. A relatively wide gap remains between the pistons in this parallel positioning. The relatively wide gap expands or widens itself during the further rotation of the pistons into a triangular space or chamber as shown in the illustrated sectional view of FIG. 3 and after the suction chamber, this gap widening into the triangular space opens as soon as the piston corner or edge region 28 of the lower piston 7 disengages from the inner cylindrical surface 13 of the upper piston 6 (FIG. 3). The space or chamber enclosing the working or operating gas during the phase of the enclosure lying therebetween accordingly is not constricted or contracted and narrowed but rather is enlarged and expanded.

A further space or chamber triangular in section closes briefly between the outer transitional surface 23 of the upper piston 6 and the inner transitional surface 17 of the lower piston 7 upon engagement or contacting of the corner or edge 27 of the upper piston 6 with the inner cylindrical surface 13 of the lower piston 7 as shown by FIG. 5 upon termination of the subsequent rolling-off of the curves 19 contacting or engaging against the mentioned transitional surfaces 17 and 23. This triangular chamber is opened to the suction side again subject to formation of a relatively wide gap in the further turning or rotation. This gap expands or enlarges outwardly during further turning or rotation and via this expanding gap the working or operating gas is exhausted as pushed-out by the outer cylindrical surface 23 of the lower piston 7. The passing of the transitional surfaces 21 and 15 of the upper piston 6 along the transitional surfaces 16 and 22 in the lower piston 7 following or succeeding the further turning or rotation results and takes place in a mirror-image manner relative to the previously described procedure and both of the two passes repeat themselves during passing of the transitional surfaces of the arm, lobe or vane 10 of the upper piston upon the lower piston 7 on the left side thereof in FIG. 1. Accordingly, there is shown and demonstrated that in none of the passing phases of the transitional surfaces among each other can there occur, arise or be encountered any gas enclosures converging, contracting or constricting themselves therewith. The movement to the parallel positioning of the transitional surfaces during plunging or telescoping of the piston corner or edge region, for example 28, 30 of the lower piston 7 into the space or chamber between the inner transitional surfaces 17, 16 and the inner cylindrical surface 13 of the upper piston 6 as shown in FIGS. 1 and 2, forces only briefly a smooth flow or stream of the working or operating gas and leads immediately to an enlargement or expansion to the triangular space or chamber as shown in FIGS. 3 and 4. Just so there occurs immediately a conversion of the parallel space or chamber into an expanding space enlargement during departure or leaving of the parallel space or chamber.

The characterizing features of the foregoing improvements in combination with the rotary piston blower having piston lobe or vane portions shaped to avoid compression pockets when operating in meshing engagement can be noted as a listing of the following features:

I) The inner cylindrical surfaces 12, 13 in a radial section extend over a partial circle or arc of 90° (FIG. 1) and have a transition into smooth or level inner transitional surfaces 14, 15, 16, 17 which are further joined extending into curved or bent relationship in a transitional surface 19 spaced relative to the longitudinal axis of the pistons 6, 7 and also joined extending into smooth or level outer transitional surfaces 20, 21, 22, 23 located in positioning defining a relationship over an arcuate distance angularly in an arc of 120° (FIG. 1), defined between the inner transitional surfaces 14, 15, 16, 17 as to outer transitional surfaces 20, 21, 22, 23 respectively, which transitional surfaces intersect the outer cylindrical surfaces 24, 25 at a tangent located in a piston corner or edge region 27, 28, 30 respectively also in an arc of 120° (FIG. 1) between the tangent and the outer transitional surface (s) 21 for example.

II) The radially outer edges of the inner transitional surfaces 14, 15, 16, 17 of the one piston 6, 7 contact or engage each other in a position of the piston 6, 7 in which these inner transitional surfaces 16 or 17 of the one piston 6, 7 respectively lie in a plane with the inner transitional surface 17 or 15 of the other piston.

III) The rounding-off or curve 19 is a mating or a rolling-off curve of the corresponding rounding-off or curve 19 of the counter piston.

IV) An indentation, recess or niche 29 is provided in the inner transitional surface 14, 15, 16, 17 respectively close by of near the radially outer edge thereof and extending over the entire axial length of this transitional surface.

An object of the present invention is to develop or evolve a machine or engine as a blower or supercharger to be produced very simply and with very little cost. The machine has a high delivery rate with small structural size and with small or nominal drive capacity, as much as possible noiseless, silenced or low as to noise and quiet in operation and producing no disturbing pressure pulsations. The machine accordingly is well adapted and suited for the loading or charging of multicylinder internal combustion engines, for exhaust gas blowers or superchargers or as conveying blowers or superchargers for technical purposes.

These conditions or requirements could not be met or fulfilled previously, thus being satisfied only very inadequately by the previously known blowers or superchargers. The present inventive blower or supercharger fulfills such conditions or requirements in a surprising manner in the entirety thereof on the basis of structural features described in the present disclosure.

The present invention is, of course, in no way restricted to the specific disclosure of the specification and drawings, but also encompasses any modifications within the scope of the appended claims.

What I claim is:

1. In an external axial rotary piston blower having a casing with two semicylindrical axially parallel inner cylindrical surfaces as well as two identically shaped rotary pistons each having a longitudinal axis as well as a pair of oppositely extending identical lobe portions operating in meshing engagement with lobe portions of a corresponding rotary piston, the improvement in combination therewith comprising:

outer cylindrical surfaces extending arcuately uninterrupted and smoothly along outer diametrically opposite locations of said lobe portions of each rotary piston respectively;

a pair of shafts parallel to each other and having an axis of rotation respectively connecting with the longitudinal axis of each of said rotary pistons centrally thereof;

inner cylindrical surfaces of each rotary piston provided centrally in a location on opposite sides thereof smoothly curved arcuately outwardly to extend over a partial circle and having a transition from said inner cylindrical surfaces on opposite sides into smooth inner transitional surfaces which are located in a transitional portion relative to a longitudinal axis of each rotary piston and then proceeding from said inner transitional surfaces into smooth outer transitional surfaces proceeding transitionally with respect to each other as well as spaced relative to longitudinal axis of the piston, which transitional surfaces meet at a corner location respectively, said transitional surfaces of respective pistons progressively engaging each other continuously and smoothly to avoid compression pockets therebetween that would encompass gas enclosures, squeeze or compression flows and wedge effects completely avoided at diametrically outwardly located ends of said lobe portions which mate interengaging completely complementary to each other in sealing relationship continuously progressing during cooperation along outer cylindrical surfaces smoothly passing against inner cylindrical surfaces as well as inner transitional surfaces and outer transitional surfaces respectively.

2. The rotary piston blower according to claim 1, wherein radially outer edges of the inner transitional surfaces of each rotary piston are located closely adjacent relative to each other in a position of the rotary pistons in which these inner transitional surfaces of the one rotary piston lie in a plane with the inner transitional surface of the other rotary piston.

3. The rotary piston blower according to claim 1, wherein one rotary piston has a curve inner cylindrical surface portion complementary with respect to a corresponding curve outer cylindrical surface portion of the other rotary piston respectively when located complementary closely adjacent relative to one another.

4. The rotary piston blower according to claim 1, wherein furthermore an indentation is provided as a niche located in the inner transitional surface closely adjoining a radially outer edge thereof and extending over the entire axial length of this transitional surface of identical lobe portions of each portion so that escape of gas is improved thereby at this location.

5. A rotary piston blower having a casing with two parallel interconnecting cylindrical casing runway surfaces as well as two side walls at right angles to the casing runway surfaces collectively enclosing hollow chambers formed thereby, which have inlet and outlet openings provided in a region of opposite locations of inner sections of the casing runway surfaces and including shaft means which pass parallel to each other and journalled axially in the side walls and having two identically shaped rotary pistons arranged fixedly on said shaft means respectively as well as having oppositely extending identical lobe portions operating counter to each other though intermeshing with equal rotary speed free of engagement, comprising the following features as improvements therewith:

(a) a shape of said piston means on the one hand including radially extending axially concentric outer cylindrical surface portions with axially directed edges having a large radius as well as inner cylindrical surfaces with smaller radius, of which those with large radius glide along the casing runway surfaces of the casing with smallest possible clearance and spacing being parallel in relation thereto and on the other hand also being able to roll-off with smallest possible clearance and spacing as to inner cylindrical surfaces with smaller radius for the cooperating piston means, as well as transitional surfaces being provided in angular relationship between said inner and outer cylindrical surfaces in cooperating relationship;

(b) said transitional surfaces meet at corner locations respectively between the cylinder surface portions with large and small radii being bent by an angle of 120° in two smooth engagement surfaces, with which the outer engagement surfaces are located at an angle of 120° to a tangent as to the cylinder portion surface with large radius to form such angle at an edge thereof and the inner engagement surfaces being located at an angle of 90° to each other; and (c) the bent-off portion between a pair of engagement surfaces extending in a roll-off curve along which a corresponding roll-off curve of the counter piston means rolls-off.

6. An axial rotary piston blower having a casing with two intersecting casing runway surfaces as well as two sidewalls including an inlet opening and an outlet opening provided at the intersecting of the casing runway surfaces and having two shafts that extend axially to the casing runway surfaces, each of the two shafts respectively having thereon identically shaped pistons each with two lobe portions radially symmetrical in themselves operating counter to each other though intermeshing with equal rotary speed free of engagement with gap sealing relationship, whereby the lobe portions include an outer cylindrical surfacing of each piston means with a large radius that runs complementary along the casing runway surfaces coaxially relative to the shaft axis as well as running complementary along an inner cylindrical surfacing with a small radius of the counter piston coaxial to the shaft axis thereof, comprising as improvements therewith:

that the inner cylindrical surfacing with a small radius defines an angle of 90° around the shaft axis and that the transitional surfaces between the outer cylindrical surfacing with large radius and the inner cylindrical surfacing with small radius are formed by two smooth engagement surfaces located in an outwardly directed angle, whereby each inner engagement surface is angled-off in an angle of 90° to the tangent of the inner cylindrical surfacing with small radius.

7. A rotary piston blower according to claim 6, in which the transition between the inner and outer engagement surfaces is rounded-off.

8. A rotary piston blower according to claim 7, in which the inner engagement surface is provided with an indentation extending in axial direction from edge to edge therewith.

9. An axial rotary piston blower machine comprising the following features including general features of:

(a) a housing consisting of a casing with two intersecting cylindrical casing runway surfaces including inlet and outlet openings in the intersecting locations and side parts therewith;

(b) two shafts extending and passing through the housing coaxially of the casing runway surfaces;

(c) a piston means respectively located upon each shaft and operating counter to each other though intermeshing with equal rotary speed free of engagement with a gap-sealing relationship;

(d) said piston means being radially symmetrical and identically shaped among each other;

(e) each piston means having two lobe portions;

(f) said lobe portions including outer cylindrical surfaces with large radius for complementary running along the casing runway surfaces complementary to outer cylindrical surfaces coaxial to the shaft axis and also including inner cylindrical surfaces complementary to the outer cylindrical surfaces for complementary running along inner cylindrical surfaces with small radius of the counter piston coaxially with respect to the shaft axis for intermeshing relationship as provided between the lobe portions; and further characterizing features including:

(g) that the cylindrical surfaces with large radius are connected with the cylindrical surfaces with small radius by transitional surfaces which consist of two smooth engagement surfaces angled-off outwardly by 120° among each other;

(h) the inner engagement surface bends-off from the cylindrical surface with the small radius in an angle of 90° from the tangent thereof; and (i) the bending-off between the inner and outer engagement surfaces is rounded-off.

* * * * *

UNITED STATES PATENT AND TRADEMARK OFFICE

CERTIFICATE OF CORRECTION

PATENT NO. : 5,039,289

DATED : Aug. 13, 1991

INVENTOR(S) : Dankwart Eiermann and Wolfgang Sohler

It is certified that error appears in the above-identified patent and that said Letters Patent is hereby corrected as shown below: ON THE TITLE PAGE:

Related U.S. Application Data

[63] Continuation of Ser. No. 784,722, Oct. 4, 1985, abandoned, which is a continuation-in-part of Ser. No. 667,952, Nov. 2, 1984, abandoned.

Signed and Sealed this

Twelfth Day of January, 1993

*Attest:*

*Attesting Officer*

DOUGLAS B. COMER

*Acting Commissioner of Patents and Trademarks*